US005810579A

United States Patent [19]

Lin

[11] Patent Number: 5,810,579

[45] Date of Patent: Sep. 22, 1998

[54] HOT GAS SPRAY PISTOL

[76] Inventor: Arlo H. T. Lin, No. 5, Lane 25, Tatung Rd., Wu Fong Hsiang, Taichung Hsien, Taiwan

[21] Appl. No.: 710,921

[22] Filed: Sep. 24, 1996

[51] Int. Cl.[6] ..... F23D 14/12

[52] U.S. Cl. ..... 431/328; 431/255; 431/158; 126/406

[58] Field of Search ..... 431/328, 158, 431/255; 126/406, 403, 407

[56] References Cited

U.S. PATENT DOCUMENTS

| | | | |
|---|---|---|---|
| 4,726,767 | 2/1988 | Nakajima | 431/255 |
| 5,215,456 | 6/1993 | Fujiwara | 126/406 |
| 5,460,520 | 10/1995 | Lin | 126/406 |

*Primary Examiner*—Carroll B. Dority
*Attorney, Agent, or Firm*—Pro-Techtor International Services

[57] ABSTRACT

A palm top hot air gas spray pistol including a base case for accommodating gas and an upper cover containing a gas guide and ignition mechanism. The upper cover includes a nozzle formed by a spray tube and an outer cover. Ignition is controlled by pressing a push-button. A hot air tube is fitted onto the outer cover. The hot air tube has a front end portion of a smaller diameter, which is provided with a ceramic block resembling a honey-comb. The ceramic block is mounted between a front end of the hot air tube and the spray tube. The intense heat of the flame of the pistol is used to generate hot air which is ejected through the hot air tube. The spray pistol has good portability and may also be used as a hot air pistol.

5 Claims, 4 Drawing Sheets

HOT GAS SPRAY PISTOL

BACKGROUND OF THE INVENTION (a) Field of the Invention

The present invention relates generally to a hot gas spray pistol, and more particularly to a portable gas spray pistol which may also be used as a hot air pistol.

(b) Description of the Prior Art

In the past, high-temperature flame generating devices were usually bulky and were therefore inconvenient to carry. Besides, it was difficult to refill them once the gas was used up. The recently developed gas spray pistol are becoming more and more popular today. They have the advantages of small size, easy operation and portability. And if the gas is used up, they can be refilled using disposable lighters commonly available at convenient stores.

Such kind of gas spray pistols, as shown in FIGS. 1 and 2, generally comprises an upper cover 10 and a base case 20, which may be coupled together. A lighter, such as a disposable lighter mentioned above, may be inserted into the base case 20. The upper cover 10 is provided with a gas control mechanism. On the press of a control button 11, gas within the base case 20 is released. With the cooperation of an ignition mechanism in the upper cover 10, the ejected gas may be ignited to form a high-temperature flame for various heating purposes.

Constant development of such kind of gas spray pistols has enabled them to generate intense flames of higher temperatures. However, in processing workpieces which cannot contact flames directly, such as in the case hot deforming, such gas spray pistols are not applicable.

SUMMARY OF THE INVENTION

Accordingly, a primary object of the present invention is to provide a hot gas spray pistol in which an engageable element is provided at a gas nozzle of the pistol, the element having a ceramic block pre-inserted at a front end thereof, so that the high-temperature flame ejected from the nozzle may directly heat the ceramic block, forming hot gases.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
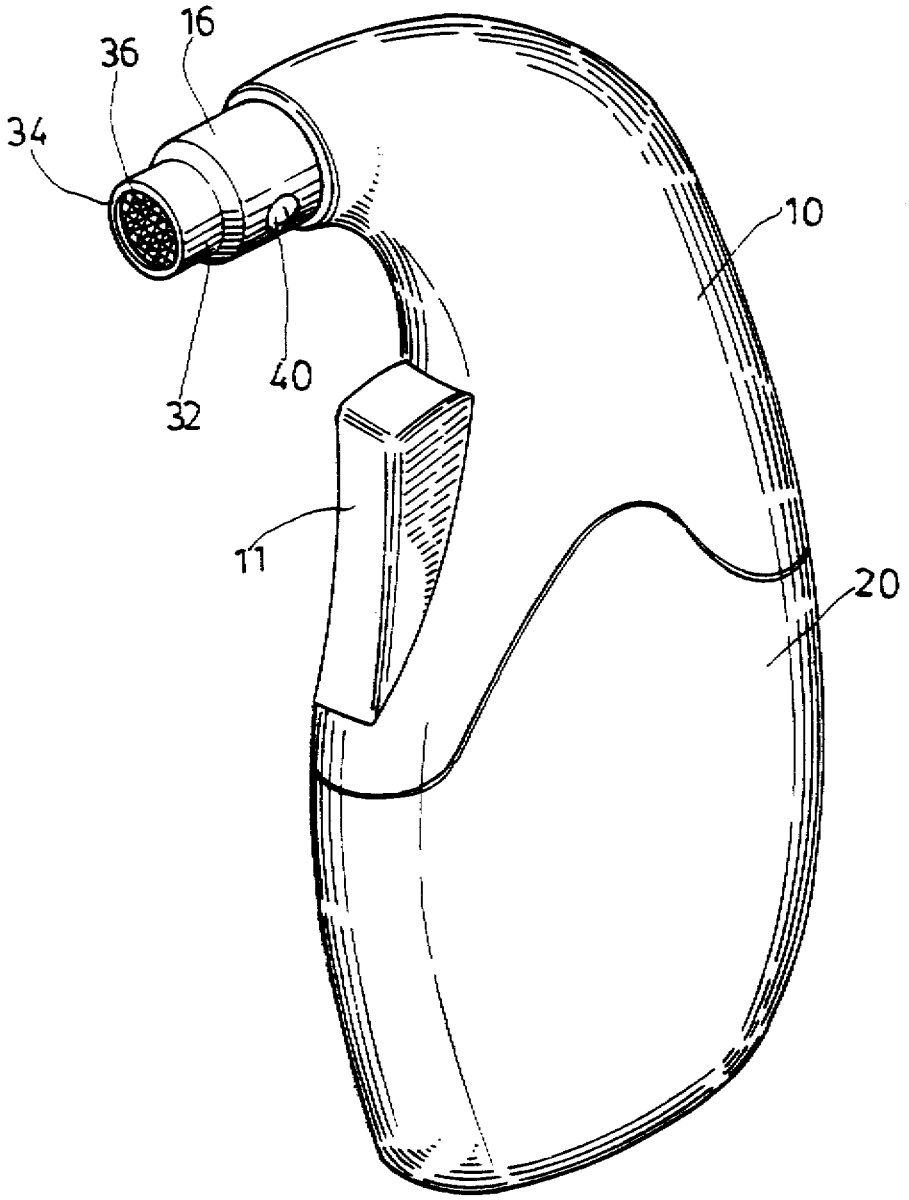
FIG. 1 is an elevational view of a preferred embodiment of the present invention.
Figure 2:
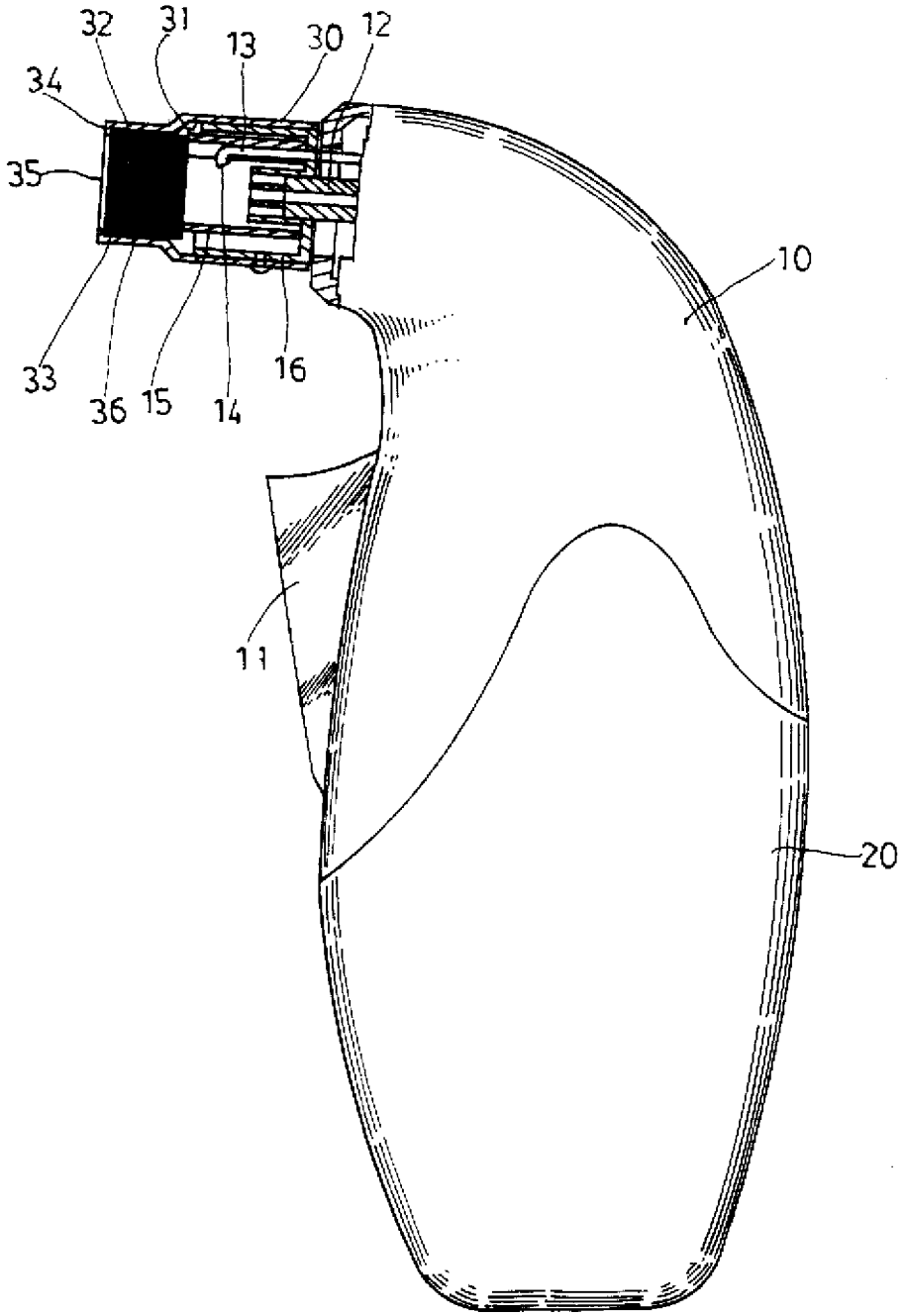
FIG. 2 is a sectional view of FIG. 1.

With reference to FIGS. 1 and 2, existing gas spray pistols essentially comprises a base case 20 for accommodating a lighter, such as a disposable lighter, and an upper cover 10 containing a gas guide mechanism and an ignition mechanism. As shown in FIG. 2, when gas is connected and ejected through a passage of an outlet tube 12 to the outside, with the pressing of a push-button 11, sparks will be generated at a tube end 14 of a flame tube 13 via an electronic ignition mechanism (not shown) disposed inside the upper cover 10, hence igniting the ejected gas, and the intense, high-temperature flame is ejected by a spray tube 15.

The present invention is characterized in that the spray tube 15 has an outer cover 16 which is fitted with a hot gas tube 30. The hot gas tube 30 is provided with an internal hole 31 of a suitable diameter so that the hot gas tube 30 may fit onto the outer cover 16. At the same time, the hot gas tube 30 is provided with a front end portion 32 of a smaller diameter. The front end portion 32 has an internal hole 33 of a smaller diameter and a front radial annular bent rim 34 for forming a front orifice 35 of a suitable diameter. The front end portion is sized such that a ceramic block 36 in the shape of a honey-comb may be inserted thereinto. The ceramic block 36 is fitted into the internal hole 33 such that one end thereof abuts an inner rim surface of the annular bent rim 34 while the other end thereof abuts a front end surface of the spray tube 15.

The entire hot gas tube 30 can have its internal hole 31 tightly fitting onto the outer cover 16. However, corresponding radial holes 37 and 17 may be formed at the hot gas tube 30 and the outer cover 16 respectively so that a suitably long bolt 40 may be used to lock them together after they are coupled. Certainly, the bolt 40 may be removed to separate the hot gas tube 30 from the outer cover 16 when hot air is not required so that the spray pistol of the invention merely produces high-temperature flames.

After the hot gas tube 30 is fitted in place, by pressing the push-button 11, the flame thus generated will heat the ceramic block 36 at the front end of the spray tube 15 directly. The hot air is blown by the force ejecting the flame via the front orifice 35 to treat a workpiece.

Figure 3:
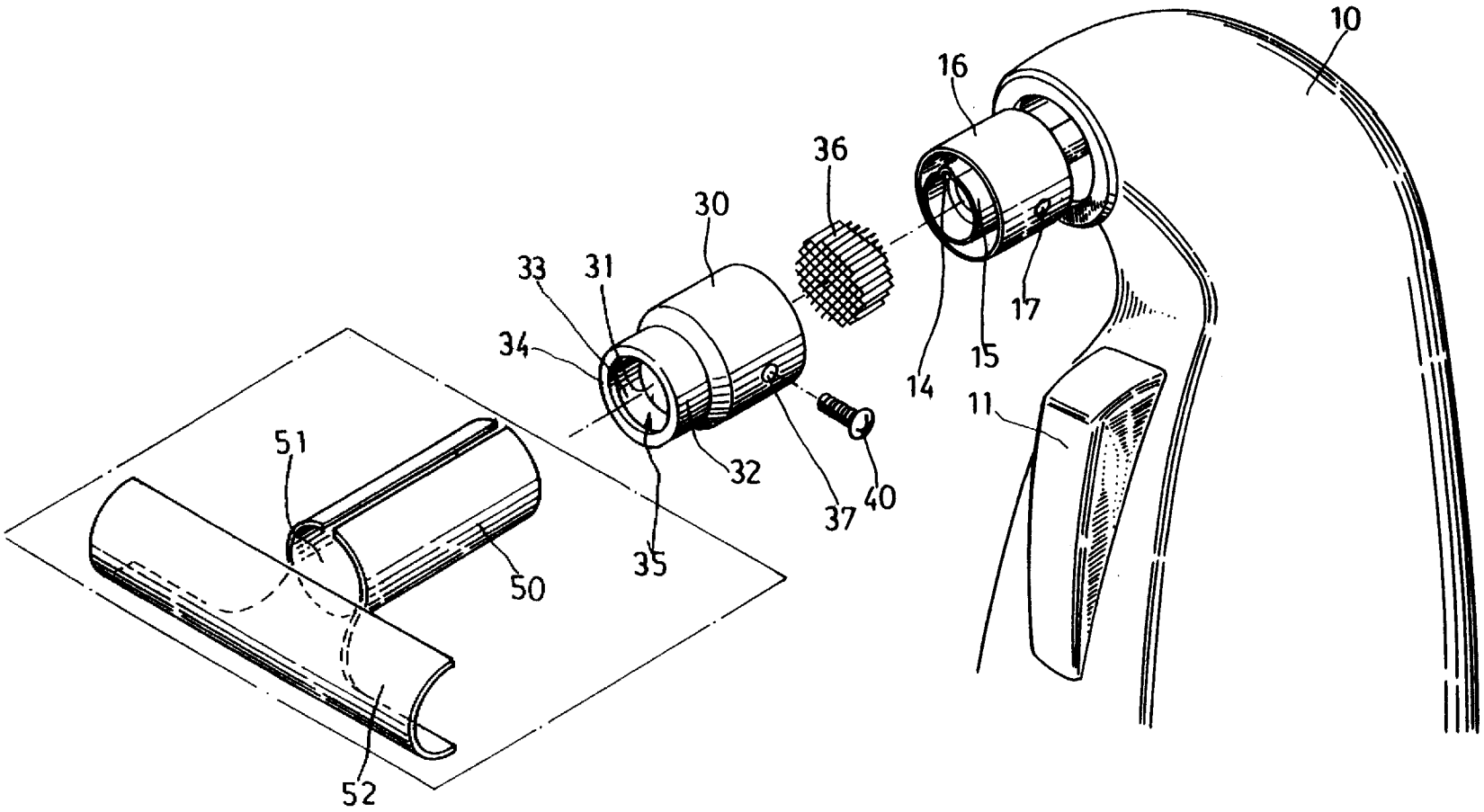
FIG. 3 is an exploded view of another preferred embodiment of the present invention.
Figure 4:
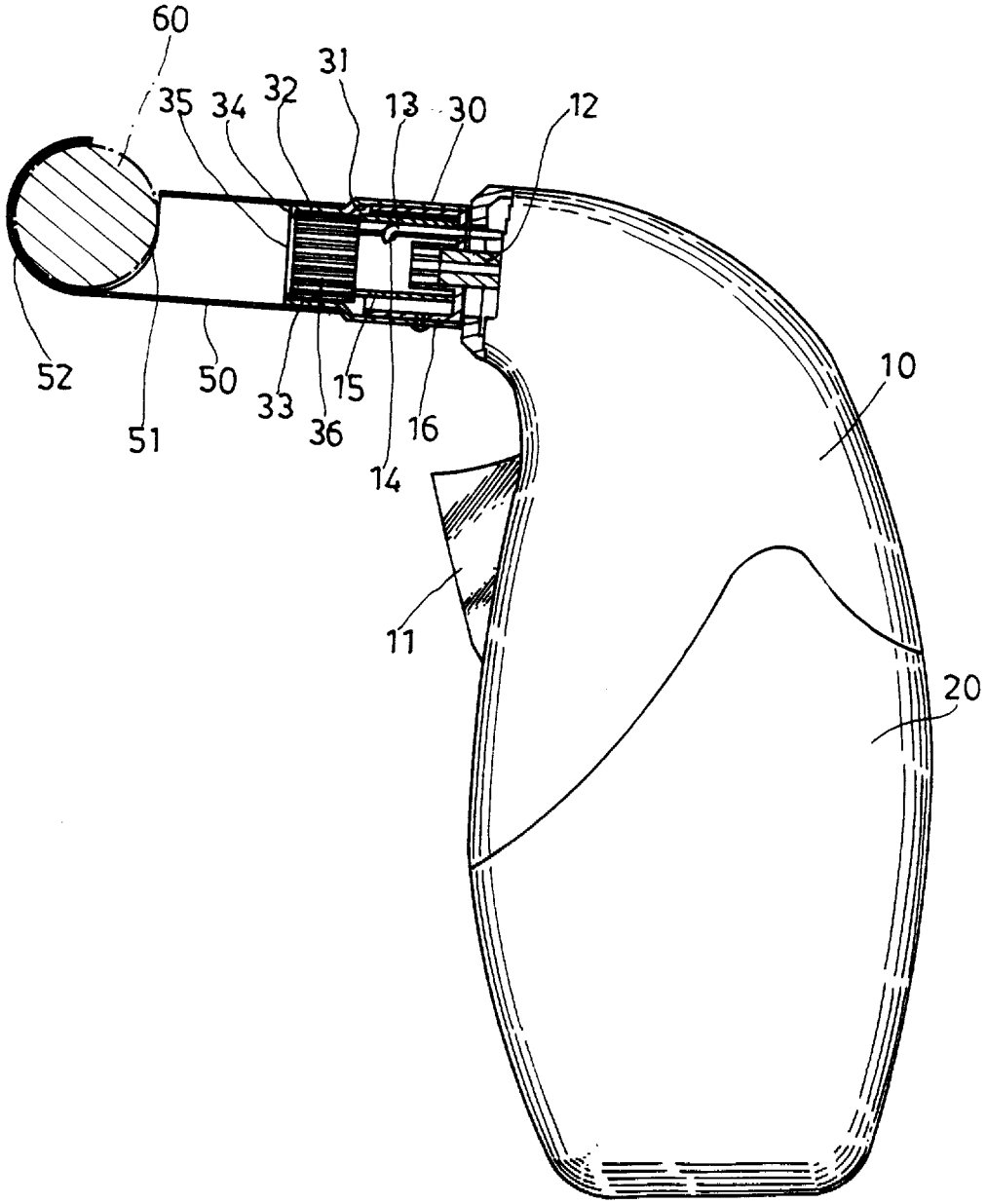
FIG. 4 is a schematic sectional view of FIG. 3, illustrating hot air working.

Reference is now made to FIGS. 3 and 4 which show another preferred embodiment. In addition to the manner of generating gases in hot working, as described above, the front end portion 32 of the hot gas tube 30 may also be fitted with a relatively long hollow guide tube 50 having a front orifice 51. A horizontal curved piece 52 is provided to extend from a bottom rim of the front orifice 51 of the guide tube 50. A workpiece 60 may be placed on the curved piece 52 (see FIG. 4) so that the hot gases may reach the workpiece 60 more stably and directly.

As described above, the present invention may be selectively provided on existing spray pistols to enable the latter to be used as a hot gas pistol, hence providing a vast improvement over the existing art.

Although the present invention has been illustrated and described with reference to the preferred embodiment thereof, it should be understood that it is in no way limited to the details of such embodiment but is capable of numerous modifications within the scope of the appended claims.

What is claimed is:

1. A hot gas spray pistol, comprising: a base case for accommodating gas, and an upper cover containing a gas guide and ignition mechanism, said upper cover having a nozzle formed by a spray tube and an outer cover of said spray tube, ignition being controlled by a push-button provided on said upper cover, a hot gas tube tightly fitting onto said outer cover and having a front end portion of a relatively smaller diameter than a rear end portion said front end portion being provided with a ceramic block of a honey-comb shape, said ceramic block being mounted between an orifice of said front end portion of said hot gas tube and said spray tube, forming a combustion chamber upstream of said ceramic block such that the intense heat generated by the flame produced by the gas spray pistol is ejected in the form of high-temperature gases.

2. The hot gas spray pistol as claimed in claim 1, wherein said ceramic block has one end abutting a front short radial annular bent rim of said hot gas tube and the other end abutting a front end of said spray tube.

3. The hot gas spray pistol as claimed in claim 1, wherein said hot gas tube and said outer cover are each provided with a corresponding radial through hole for passage of a screw bolt for locking said hot gas tube and said outer cover together.

4. The hot gas spray pistol as claimed in claim 1, wherein said front end of said hot gas tube may further be provided with a hollow guide tube of a relatively great length.

5. The hot gas spray pistol as claimed in claim 4, wherein said guide tube has a horizontal curved piece extending from a front bottom edge thereof for supporting a workpiece.

* * * * *